114-242
7/29/86 XR 4,602,589

United States Patent [19]

Quinata

[11] Patent Number: 4,602,589

[45] Date of Patent: Jul. 29, 1986

[54] SNORKLING BOARD AND ACCESSORY PROPULSION UNIT THEREFOR

[76] Inventor: Pete S. Quinata, P.O. Box 755, Makawao, Hi. 96768

[21] Appl. No.: 674,521

[22] Filed: Nov. 23, 1984

[51] Int. Cl.[4] ..... B63C 11/46

[52] U.S. Cl. ..... 114/315; 114/242

[58] Field of Search ..... 114/242, 244, 315, 332, 114/337; 440/21-32; 272/1 B, 71

[56] References Cited

U.S. PATENT DOCUMENTS 3,245,640 4/1966 Ibbs ..... 440/6
3,999,501 12/1976 Duarte ..... 440/27

FOREIGN PATENT DOCUMENTS 1906232 8/1970 Fed. Rep. of Germany ..... 114/315
795194 5/1958 United Kingdom ..... 114/315

*Primary Examiner*—Trygve M. Blix
*Assistant Examiner*—Jesûs D. Sotelo
*Attorney, Agent, or Firm*—Harvey B. Jacobson; Clarence A. O'Brien

[57] ABSTRACT

An elongated buoyant body is provided having opposite longitudinal sides and fore and aft ends. The body includes a rear vertically extending and rearwardly opening recess formed therein spaced inwardly of the rear ends of said sides and of a width to receive a prone snorkler therein. A central elongated handgrip bar is supported from the body in the forward portion of the recess and is adjustable longitudinally of the body. The rear end of the body supports a forwardly opening U-shaped structure therefrom which projects rearwardly of the body and includes a rear crosspiece from which an outboard trolling motor may be mounted.

12 Claims, 7 Drawing Figures

FIG. 3
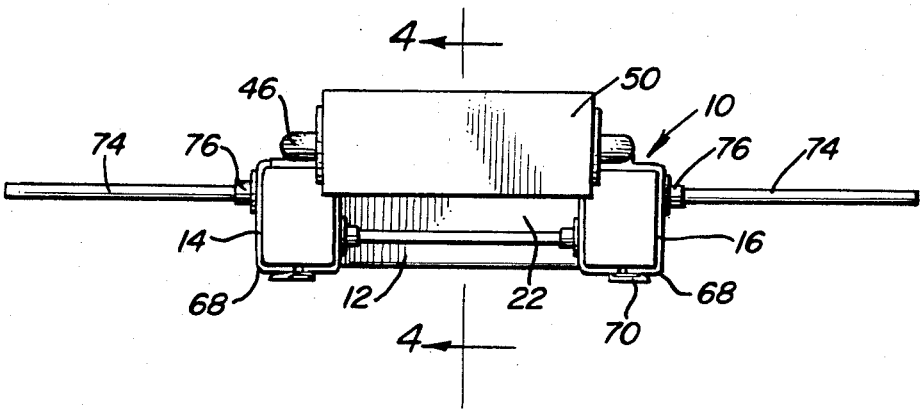
FIG. 4
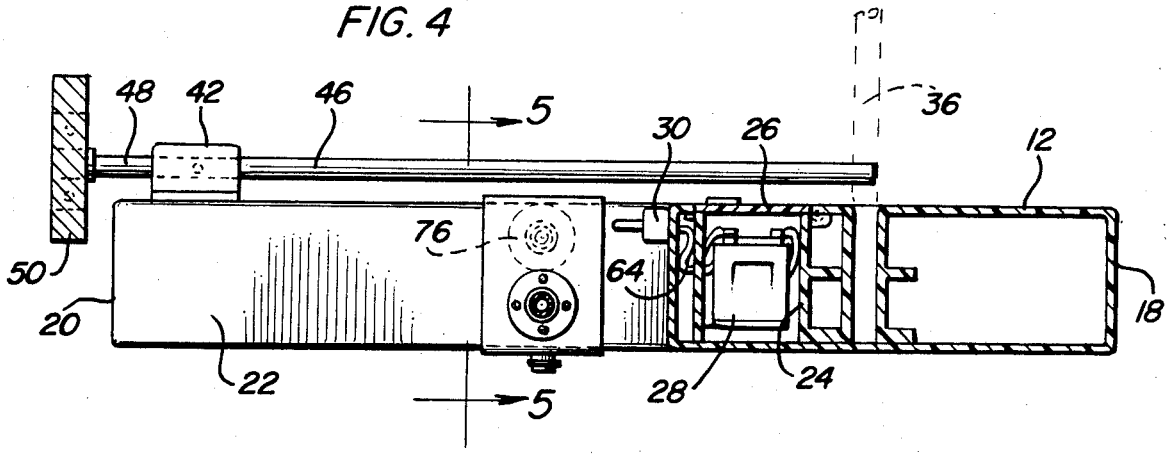
FIG. 5
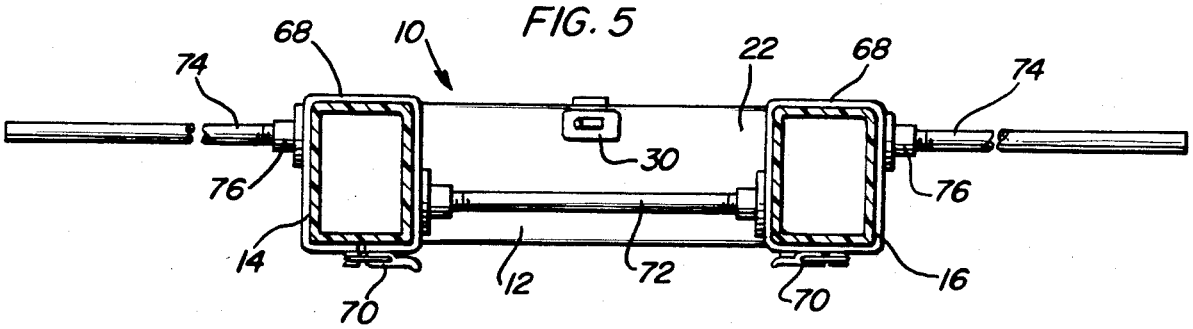
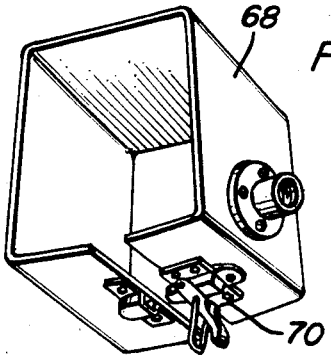
FIG. 6
FIG. 7
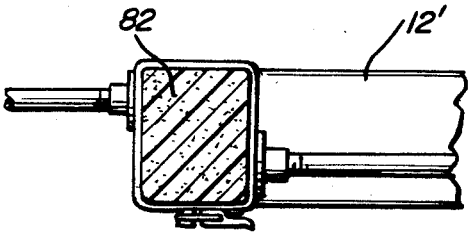

SNORKLING BOARD AND ACCESSORY PROPULSION UNIT THEREFOR

BACKGROUND OF THE INVENTION

1. Field of the Invention

This invention relates to a buoyant swimming aid in the form of an elongated body including a rearwardly opening recess for receiving the upper body portion of a prone snorkler and the body is designed to be propelled by a snorkling user equipped with swim fins or by a trolling motor mounted on a forwardly opening U-shaped frame mounted from the rear of the body.

2. Description of Related Art

Different forms of buoyant swimming aid boards and board-like bodies hereto have been provided as well as various different manually and motor propelled swimming and diving aids which include some of the general structural and operational features of the instant invention. Examples of such previously known devices are disclosed in U.S. Pat. Nos. 1,222,114, 1,503,624, 2,936,466, 2,948,251, 3,067,441, 3,084,654, 3,420,202, 3,650,234 and 3,768,431.

However, these previously known devices do not include the overall combination of structural features of the instant invention which provide for a readily manually or motor propelled snorkling board.

SUMMARY OF THE INVENTION

The snorkling board of the instant invention has been specifically designed to enable a snorkling user to readily propel himself over the surface of a body of water or to be propelled through the utilization of a trolling motor mounted on an accessory motor mounting bracket provided for the board. The board is further designed to be used either by a single snorkler or by two or three snorklers.

Further, when the board is to be propelled through the utilization of an electric trolling motor the board is equipped with a cavity in which to receive a storage battery comprising a source of electrical potential for the trolling motor. In addition, when the board is equipped with the trolling motor mounting accesssory therefor additional bracing is provided between rear opposite side portions of the board by the accessory.

The main object of this invention is to provide a swimmer's board to be used by snorkling persons and which may be either manually propelled or propelled through the utilization of an outboard motor.

Another object of this invention is to provide a snorkling board which may accommodate only a single snorkler, if desired, or as many as three snorklers.

A further object of this invention is to provide a snorkling board which may also be equipped with a small sail so as to be wind-propelled.

A further object of this invention is to provide a snorkling board which may be readily carried to and from the water, whether the board is being used as a manual propulsion board or as an electric trolling motor propelled board.

A final object of this invention to be specifically enumerated herein is to provide a snorkling board in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a rear elevational view of the assemblage illustrated in FIG. 1 with the electric trolling motor removed;

FIG. 4 is an enlarged longitudinal vertical sectional view taken substantially upon the plane indicated by the section line 4—4 of FIG. 3 and with the electric trolling motor propulsion unit mounting bracket illustrated in a retracted position;

FIG. 5 is a transverse vertical sectional view taken substantially upon the plane indicated by the section line 5—5 of FIG. 4 with portions of the opposite side outwardly projecting handgrip bars being broken away and the propulsion unit mounting bracket removed;

FIG. 6 is an enlarged perspective view of one of the handgrip bar clamp-type mounting brackets; and FIG. 7 is a fragmentary longitudinal vertical sectional view illustrating a modified form of board wherein the board is solid and molded of closed-cell foam.

DESCRIPTION OF THE PREFERRED EMBODIMENTS

Figure 1:
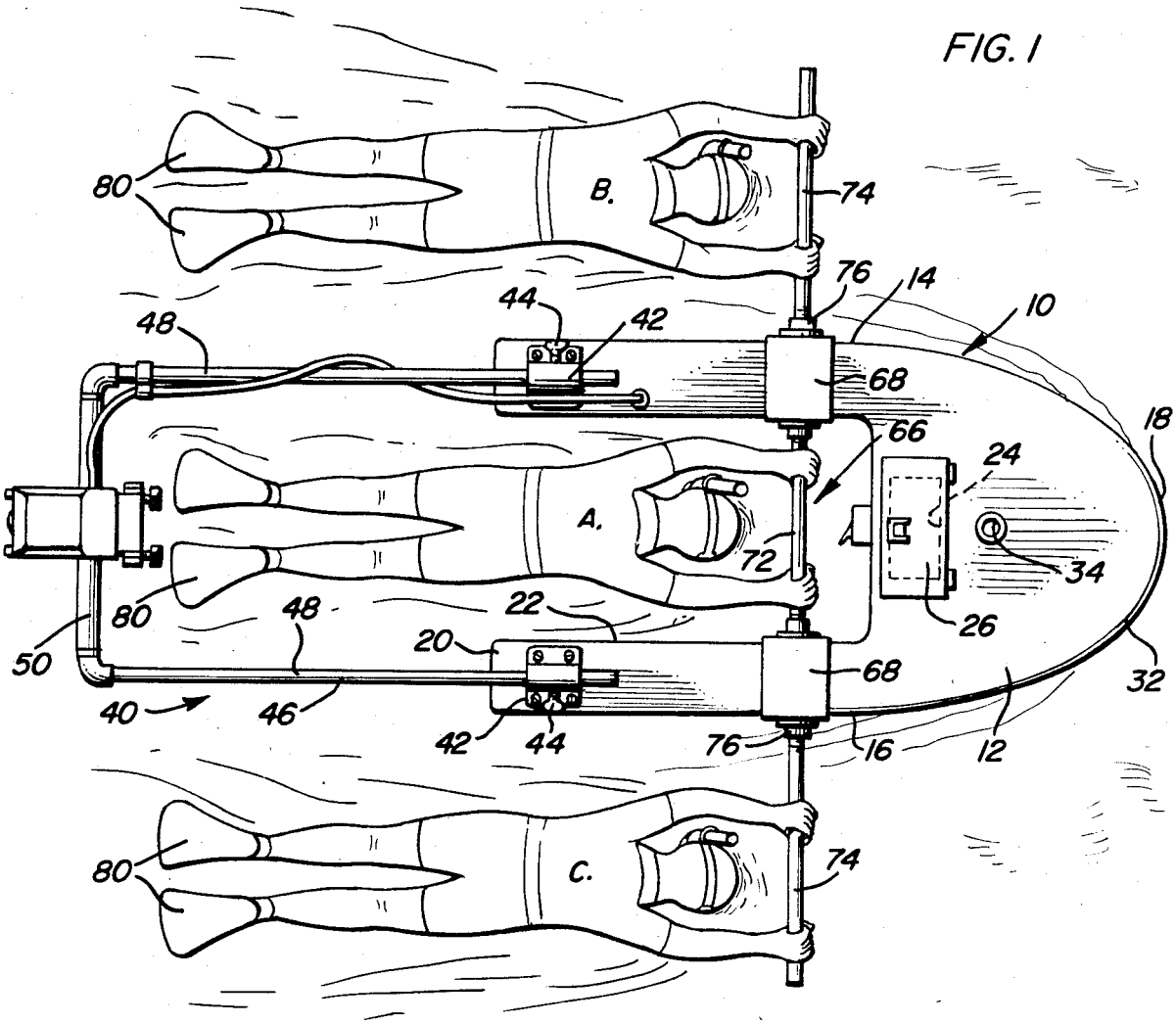
FIG. 1 is a top plan view of the snorkling board of the instant invention having an electric trolling motor propulsion unit operatively associated therewith and with the board being used by three snorklers.
Figure 2:
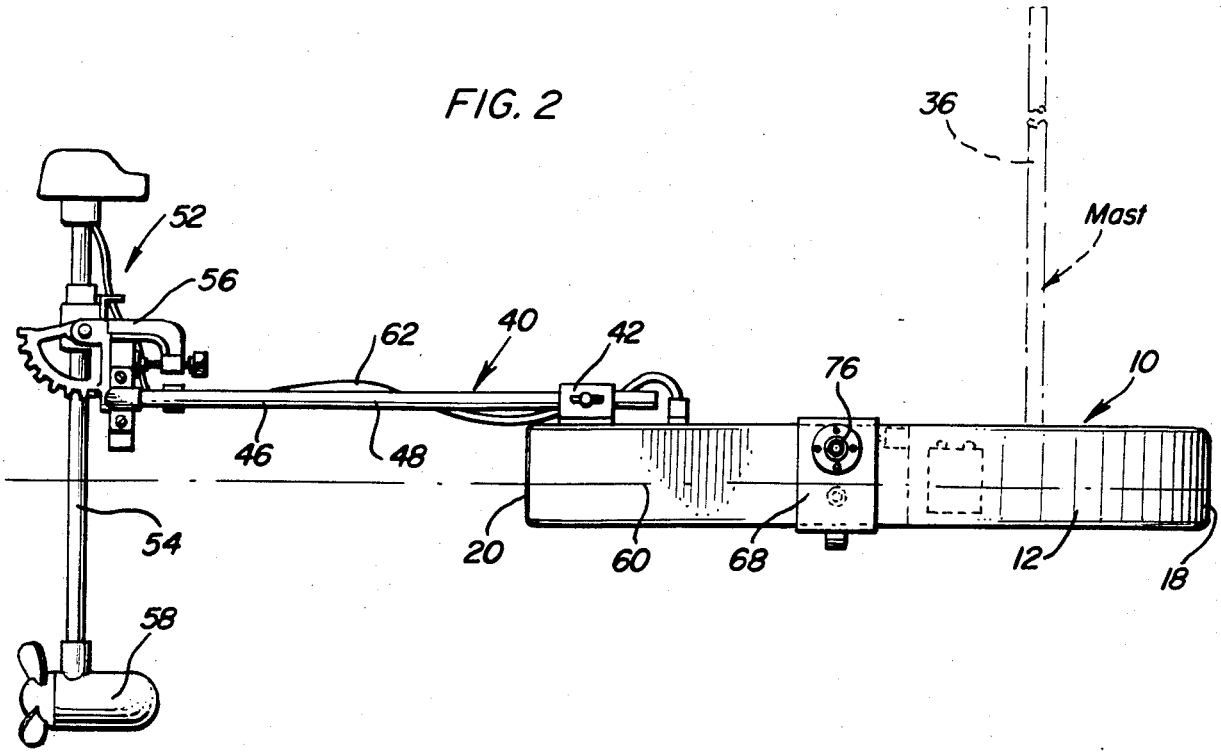
FIG. 2 is a side elevational view of the snorkling board illustrated in FIG. 1 and with a mast accessory illustrated in phantom lines.

Referring now more specifically to the drawings the numeral 10 generally designates a first form of snorkling board constructed in accordance with the present invention. The board 10 includes an elongated buoyant body 12 having opposite longitudinal sides 14 and 16 and fore-and-aft ends 18 and 20. The body 12 includes a rear vertically extending and rearwardly opening recess 22 whose opposite sides are spaced inwardly of the longitudinal sides 14 and 16.

That portion of the body 12 disposed immediately forward of the forward extremity of the recess 22 defines an upwardly opening compartment 24 provided with a recessed and hinged cover door 26. The compartment 24 may be used to enclose various articles including a storage battery 28 and the body 12 mounts a control switch 30 at the forward extremity of the recess 22 for a purpose to be hereinafter more fully set forth.

The forward end 18 of the body 12 is rounded as at 32 and the recess 22 is approximately two feet wide and three feet long. Further, the forward part of the body 12 includes an upwardly opening mast step-defining socket 34 in which the lower end of an upright mast 36 may be downwardly seated. The mast 36 may be used to fly a warning flag, or may be used to mount a small sail.

The board 10 includes an electric trolling motor propulsion unit referred to in general by the reference numeral 40 and incorporating a pair of mounts 42 secured to the upper surfaces of the opposite side rear portions of the body 12. The mounts 42 define front to rear extending sleeves and are equipped with setscrews 44. The unit 40 additionally includes a U-shaped mounting frame 46 incorporating a pair of laterally registered parallel arms 48 interconnected at one pair of corresponding rear ends by a bight portion 50 extending and secured therebetween and defining an electric trolling motor mount. The forward ends of the arms 48 are slidably received through the sleeve-defining portions of the mounts 42 and are releasably held in adjusted positions relative thereto by the setscrews 44.

The bight portion or motor mount 50 supports a conventional electric trolling motor 52 therefrom with the support shaft portion 54 of the electric trolling motor downwardly adjusted relative to the mounting bracket portion 56 thereof so that the motor and propeller unit 58 is disposed appreciably below the water level 60 of the body 12. The trolling motor 52 is electrically connected to the switch 30 by a suitable insulated conductor means 62 and the switch 30 is electrically connected to the storage battery 28 by additional suitable insulated conductor means 64. Thus, the switch 30 may be used to control operation of the unit 58.

The board 12 additionally includes a handgrip bar structure referred to in general by the reference numeral 66. The structure 66 includes a pair of openable tubular clamps 68 disposed in laterally registered and spaced apart relation. The clamps 68 are positionable about the opposite side portions of the body 12 between which the forward end portion of the recess 22 is defined and the clamps 68 include latch structures 70 which may be used to tightly releasably clamp the clamps 68 about the corresponding portions of the board 12 encircled by the clamps 68. A central handgrip bar 72 extends and is secured between the adjacent sides of the clamps 68 and a pair of opposite side outwardly projecting handgrip bars 74 have their inner ends removably threadedly engaged in fittings 76 provided therefor on the remote sides of the clamps 68.

As may be seen from FIG. 1 of the drawings a single snorkler (A) may have his or her upper torso received in the recess 22 and may engage the central handgrip bar 72 with his hands and while in a prone position. In addition, second and third snorklers (B) and (C) may also be disposed in prone positions with their hands engaged with the bars 74. The snorkler (A) has his hands immediately adjacent the switch 30 and may thus control operation of the trolling motor 52. The snorklers each are equipped with swim fins 80, as is conventional, and steerage of the board 10 may be effected by either the snorkler (A), or all three of the snorklers through the utilization of their fins 80.

With attention now invited more specifically to FIGS. 4 and 5 of the drawings, it may be seen that the board 12 is of hollow construction. If the board 12 is of hollow construction it is preferably constructed of fiberglass or a suitable molded plastic. However, with attention now invited more specifically to FIG. 7, a second form of board referred to in general by the reference numeral 12' is illustrated. The board 12' is constructed of closed-cell foam and is solid in construction as at 82.

Although the latches 70 are illustrated as being disposed on the lower sides of the clamps 68, the latches 70 may be disposed on the upper sides of the clamps 68, if desired. In addition, it may be seen from a comparison of FIGS. 1 and 4 that the frame 46 may be shifted between an extended position such as that illustrated in FIG. 1 and a retracted position with the bight portion or motor mount 50 spaced closely rearward of the rear end of the body 12 as illustrated in FIG. 4. When the mounting frame 46 is retracted it enables the board 10 to be more readily stored and carried to and from a water site.

The frame 46 is adjustably positionable along the opposite side portions of the body 12 between which the recess 22 is defined. In this manner, the central handgrip bar 72 may be positioned longitudinally of the forward end portion of the recess 22 such that the hip area of the snorkler (A) is laterally registered with the rear ends of the opposite side portions of the body 12. This enables the snorkler (A) to utilize his or her swim fins to propel and effectively steer the board 10 without interference with movement of the legs of the snorkler (A).

Further, if the board 10 is to be manually propelled, the unit 40 is removed from the mounts 42. Then, either the snorkler (A) may propel and steer the board 10, assuming that the opposite side handgrip bars 74 have been removed, or all three snorklers may propel and steer the board 10. The three foot length of the recess 22 enables the handgrip bar 72 to be positioned very close to the forward end of the recess 22 in the event the snorkler (A) is a tall person and the bar 72 to be shifted rearwardly, as needed, if the snorkler (A) is short. The adjustability of the central handgrip bar 72 longitudinally of the board 10 is extremely important if the board 10 is to be manually propelled and steered by the snorkler (A). By proper adjustment of the central handgrip bar 72 the hip area of the snorkler (A) may be precisely laterally registered with the rear ends of the opposite side portions of the body 12.

The central handgrip bar 72 may be disposed lower than the handgrip bars 74 so that an exhausted or injured snorkler disposed in the center of the body 12 may pull his or her chest area up onto that central portion of the body 12 defining the forward extremity of the recess 22. From this position a single snorkler may even hand paddle the board 10 in the event of a leg injury or leg cramps.

Further, the central snorkler (A) may be a disabled person and snorklers (B) and (C) may propel and steer the board 10. Also, the central snorkler (A) may propel and steer the board 10 and the snorklers (B) and (C) may comprise disabled persons.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A snorkling board including an elongated buoyant body having opposite longitudinal sides and fore and aft ends, said body including a rear vertically extending and rearwardly opening recess formed therein, extending vertically therethrough and spaced inwardly of the rear ends of said sides and of a width to receive a prone snorkler therein, the forward opposite side portions of said recess including handgrip means mounted and projecting inwardly from said side portions, the length of said recess being generally three feet and the width of the rear end of said recess being generally two feet, and means mounting said handgrip means from said body for adjustable shifting longitudinally of said recess.

2. The board of claim 1 wherein said handgrip means comprises opposite end portions of a handgrip bar structure extending fully between and anchored at its opposite ends from the opposite side portions of said recess.

3. The board of claim 1 including a generally U-shaped mount having a pair of generally laterally registered parallel arms interconnected at one pair of corresponding ends by a bight portion extending therebetween, the other pair of ends of said arms being mounted from the rear ends of the opposite side portions of said body defining said recess therebetween, said bight portion including means for mounting an outboard trolling motor therefrom.

4. The board of claim 3 wherein the rear ends of said opposite side portions include sleeve mounts, said other pair of end of said arms being slidably received in said sleeve mounts for adjustable positioning relative thereto, said sleeve mounts including means operative to releasably retain said other pair of ends in adjusted shifted positions relative to said sleeve mounts.

5. The board of claim 1 wherein said body includes a predetermined waterline, a generally U-shaped mount having a pair of generally laterally registered parallel arms interconnected at one pair of corresponding ends by a bight portion extending therebetween, means mounting the other pair of ends of said arms from the rear opposite side portions of said body between which said recess is defined and with said bight portion disposed rearmost and at an elevation above said waterline, an outboard trolling motor mounted from said bight portion and including a vertically adjustable support and mounting shaft from whose lower end the motor and propeller unit of said trolling motor is mounted, said mounting shaft being downwardly adjustable relative to said bight portion to position said motor and propeller unit well below the level of a prone snorkler being pulled by said board from said handgrip means.

6. The board of claim 1 wherein said body is hollow.

7. The board of claim 1 wherein said body is solid and constructed of closed-cell foam.

8. A snorkling board including an elongated buoyant body having opposite longitudinal sides and fore and aft ends, said body including a rear vertically extending and rearwardly opening recess formed therein spaced inwardly of the rear ends of said sides and of a width to receive a prone snorkler therein, a central elongated handgrip bar supported from said body in the forward portion of said recess, said central handgrip bar comprising a portion of a handgrip bar structure extending fully between and anchored at its opposite ends from the opposite side portions of said body on opposite sides of said recess, said handgrip bar structure also including opposite side laterally outwardly projecting handgrip bars mounted from and projecting oppositely outwardly of said body opposite side portions.

9. The board of claim 8 wherein said opposite side handgrip bars are removably supported from the remainder of said handgrip bar structure.

10. The board of claim 9 wherein said body includes a predetermined waterline, said opposite side handgrip bars being spaced above said waterline.

11. A snorkling board including an elongated buoyant body having opposite longitudinal sides and fore and aft ends, said body including a rear vertically extending and rearwardly opening recess formed therein spaced inwardly of the rear ends of said sides and of a width to receive a prone snorkler therein, a central elongated handgrip bar supported from said body in the forward portion of said recess, a generally U-shaped mount having a pair of generally laterally registered parallel arms interconnected at one pair of corresponding ends by a bight portion extending therebetween, the other pair of ends of said arms being mounted from the rear ends of the opposite side portions of said body defining said recess therebetween, said bight portion including means for mounting an outboard trolling motor therefrom, the rear ends of said opposite side portions including sleeve mounts, said other pair of end of said arms being slidably received in said sleeve mounts for adjustable positioning relative thereto, said sleeve mounts including means operative to releasably retain said other pair of ends in adjusted shifted positions relative to said sleeve mounts, said central handgrip bar comprising a portion of a handgrip bar structure extending fully between and anchored at its opposite ends from the opposite side portions of said body on opposite sides of said recess, said handgrip bar structure also including opposite side laterally outwardly projecting handgrip bars mounted from and projecting oppositely outwardly of said body opposite side portions.

12. A snorkling board including an elongated buoyant body having opposite longitudinal sides and fore and aft ends, said body including a rear vertically extending and rearwardly opening recess formed therein spaced inwardly of the rear ends of said sides and of a width to receive a prone snorkler therein, a central elongated handgrip bar supported from said body in the forward portion of said recess, means mounting said central handgrip bar from said body for adjustable shifting longitudinally of said recess.

* * * * *